US009145667B1

(12) United States Patent
Laurent

(10) Patent No.: US 9,145,667 B1
(45) Date of Patent: Sep. 29, 2015

(54) TOILET SANITARY SHIELD FOR MALE GENITALIA

(71) Applicant: Vladimir Laurent, Coral Springs, FL (US)

(72) Inventor: Vladimir Laurent, Coral Springs, FL (US)

( * ) Notice: Subject to any disclaimer, the term of this patent is extended or adjusted under 35 U.S.C. 154(b) by 0 days.

(21) Appl. No.: 14/571,364

(22) Filed: Dec. 16, 2014

(51) Int. Cl.
*E03D 11/00* (2006.01)
*E03D 9/00* (2006.01)
*A47K 17/02* (2006.01)

(52) U.S. Cl.
CPC .. *E03D 9/00* (2013.01); *A47K 17/02* (2013.01)

(58) Field of Classification Search
CPC ..... A47K 17/02; E03D 9/00
USPC ..... 4/254, 661
See application file for complete search history.

(56) References Cited

U.S. PATENT DOCUMENTS

| | | | |
|---|---|---|---|
| 2,600,478 | A | 6/1952 | Butcher |
| 4,910,815 | A | 3/1990 | Kelley |
| D394,900 | S | 6/1998 | Kang |
| 5,960,481 | A | 10/1999 | Deveer |
| 7,007,313 | B1 | 3/2006 | Johnson |
| 7,225,481 | B2 | 6/2007 | Culmer |
| 2008/0016607 | A1 | 1/2008 | Cottage |

*Primary Examiner* — Tuan N Nguyen
(74) *Attorney, Agent, or Firm* — Kyle A. Fletcher, Esq.

(57) ABSTRACT

The toilet sanitary shield for male genitalia is a device that is placed in the toilet to prevent the male genitalia from touching the walls of the toilet while in use.

20 Claims, 4 Drawing Sheets

TOILET SANITARY SHIELD FOR MALE GENITALIA

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of restroom or bathroom sanitation system, more specifically, an accessory configured for use shielding male genitalia during toilet usage.

SUMMARY OF INVENTION

The toilet sanitary shield for male genitalia is a device that is placed in the toilet to prevent the male genitalia from touching the walls of the toilet while in use. The toilet sanitary shield for male genitalia comprises a shield, a securing device, and a ball and socket joint.

These together with additional objects, features and advantages of the toilet sanitary shield for male genitalia will be readily apparent to those of ordinary skill in the art upon reading the following detailed description of the presently preferred, but nonetheless illustrative, embodiments when taken in conjunction with the accompanying drawings.

In this respect, before explaining the current embodiments of the toilet sanitary shield for male genitalia in detail, it is to be understood that the toilet sanitary shield for male genitalia is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the toilet sanitary shield for male genitalia.

It is therefore important that the claims be regarded as including such equivalent construction insofar as they do not depart from the spirit and scope of the toilet sanitary shield for male genitalia. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

In the drawings.

DETAILED DESCRIPTION OF THE EMBODIMENT

Figure 1:
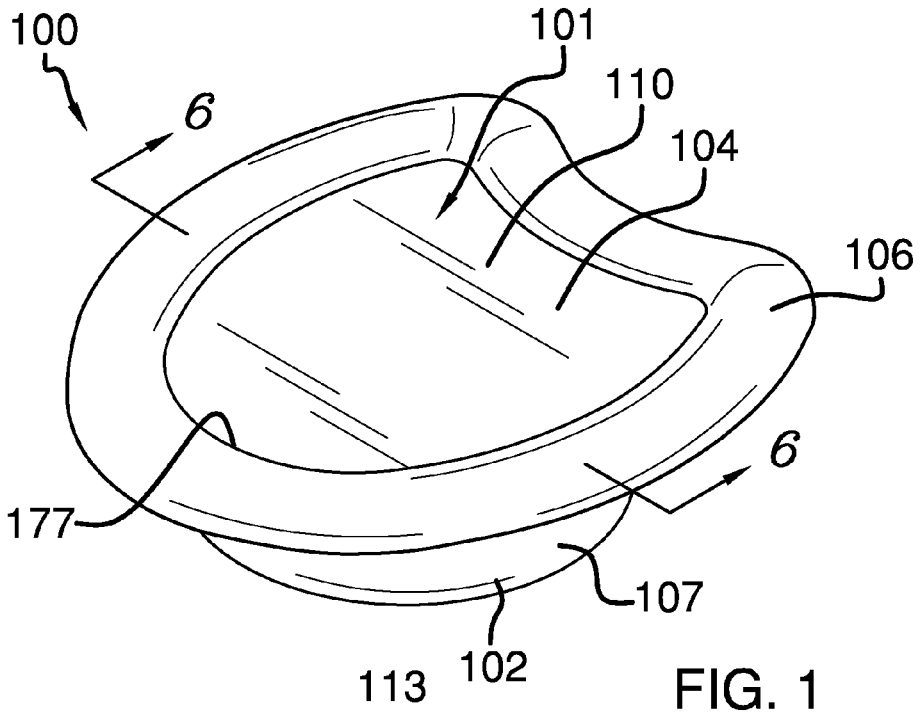
FIG. 1 is a perspective view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

In the specification and claims, the following definitions will be used:

Suction Cup: As used in this disclosure, a suction cup means an object or device that uses negative fluid pressure of air or water to adhere to nonporous surfaces by creating a partial vacuum.

Ball and Socket Joint: As used in this disclosure, a ball and socket joint means a manufactured joint or coupling in which a partially spherical object lies in a socket, allowing for multidirectional movement and rotation within limits determined by the construction of the ball and socket joint.

The toilet sanitary shield for male genitalia 100 (hereinafter invention) comprises a shield 101, a securing device 102 and a ball and socket joint 103.

The shield 101 comprises a protective plate 104, the ball portion 105 of the ball and socket joint 103, and a brim 106 around the edge of the protective plate 104. The purpose of the ball portion 105 of the ball and socket joint 103 is to provide a mechanism to attach the protective plate 104 to the securing device 102. The brim 106 is a projecting outer rim that runs along an outer edge 177 of the protective plate 104. The purpose of the brim 106 is to help contain the male genitalia 109 while it rests on the protective plate 104.

The protective plate 104 is a flat and rigid piece of material that is adapted to act as a platform upon which the male genitalia 109 rests while the invention 100 is in use. The protective plate 104 has a front side 110 and a back side 111. The front side 110 is the surface that is adapted to enable the male genitalia 109 to rest thereon. The back side 111 has attached to it the ball portion 105 of the ball and socket joint 103. The brim 106 is a projecting outer rim that runs along the outer edge 177 of the protective plate 104. The brim 106 projects out from both the front side 110 and back side 111 of the protective plate 104. The brim 106 and the protective plate 104 collectively form what is defined as the shield 101. Moreover, the brim 106 extends upwardly from the front side 110 of the protective plate 104 such that the protective plate 104 is slightly recessed with respect to the brim 106.

Figure 2:
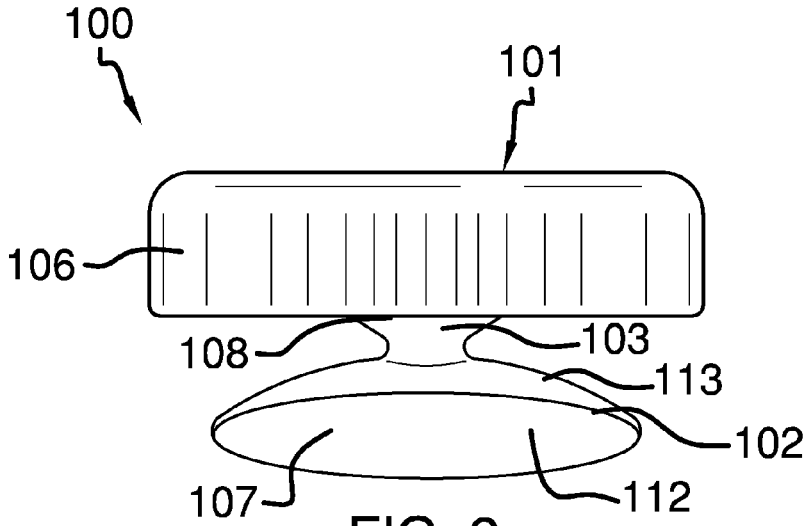
FIG. 2 is a rear view of an embodiment of the disclosure.
Figure 3:
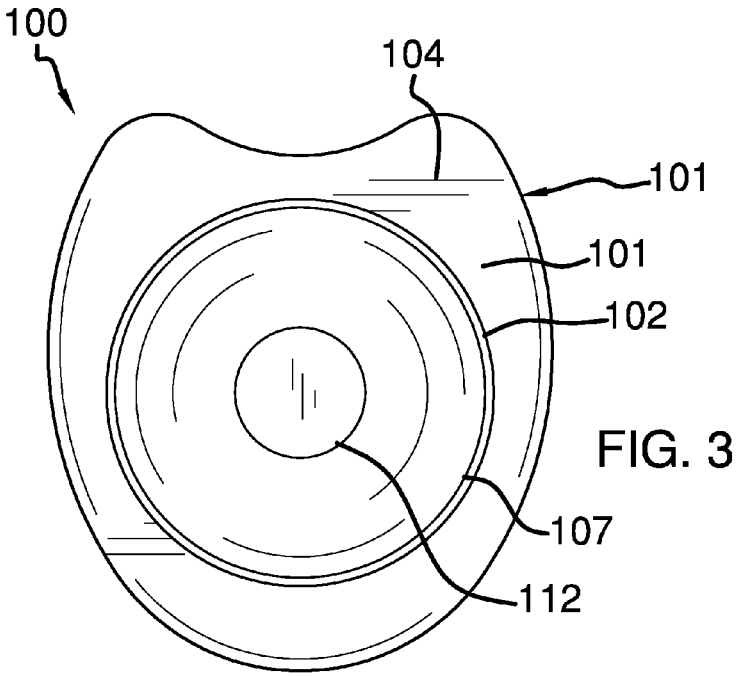
FIG. 3 is a bottom view of an embodiment of the disclosure.
Figure 4:
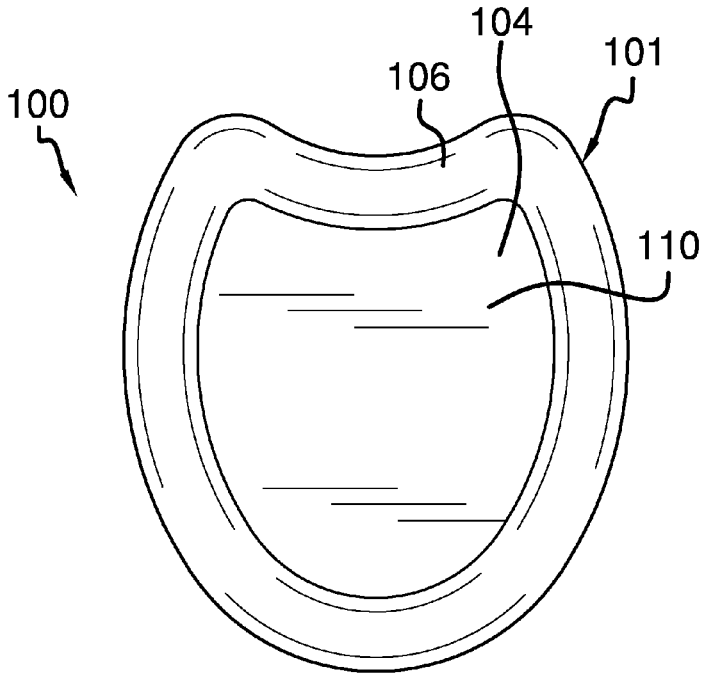
FIG. 4 is a top view of an embodiment of the disclosure.
Figure 5:
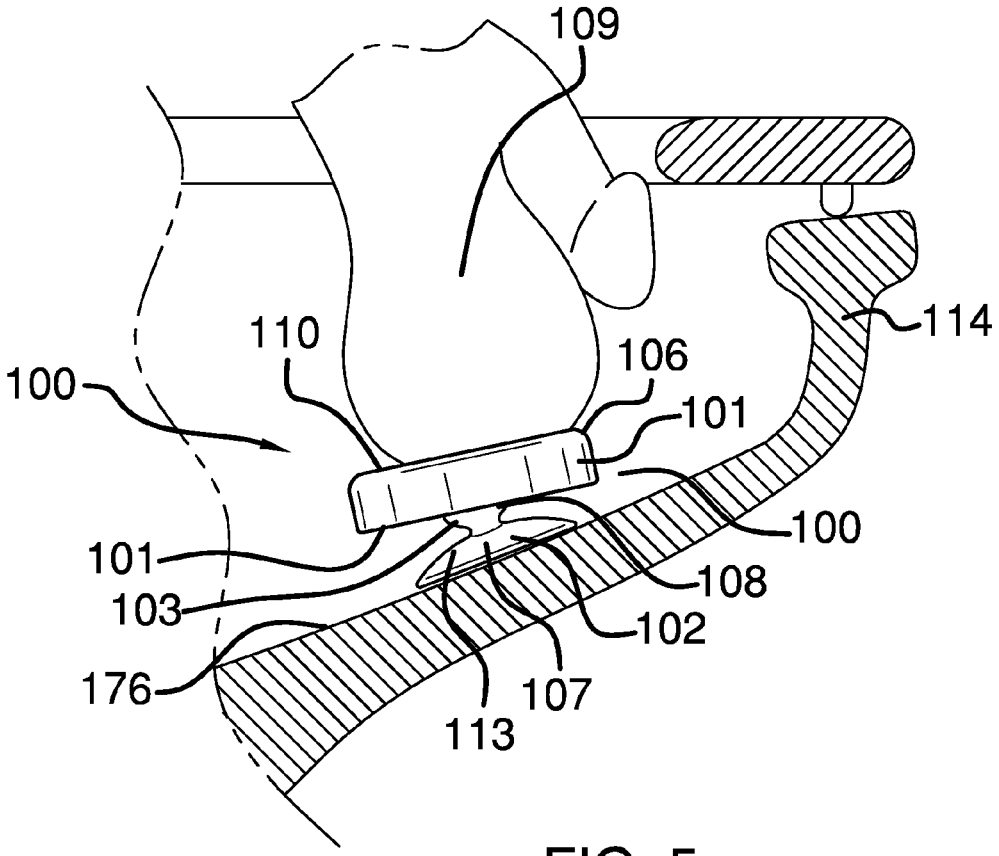
FIG. 5 is an in-use view of an embodiment of the disclosure.

The protective plate 104 can be any shape or size. In a first potential embodiment of the disclosure, as illustrated in FIGS. 1 through 5, the shape of the protective plate 104 is roughly the shape of an enclosed horseshoe. This is most clearly shown in FIGS. 1 and 4. The brim 106 is in the form of a rounded ridge that follows along the outer edge 177 of the front side 110 of the protective plate 104. This is shown most clearly in FIGS. 1 and 4. On the back side 111 of the protective plate 104 the brim 106 is in the form of a protective wall. This is shown most clearly in FIGS. 2, 3, and 4.

The ball portion 105 of the ball and socket joint 103 is a spherical dome or spherical segment that is attached to the back side 111 of the protective plate 104.

The securing device 102 comprises a suction cup 107 and a socket portion 108 of the ball and socket joint 103. The suction cup 107 is a curved semi-flexible piece of material. The socket portion 108 of the ball and socket joint 103 is attached directly to the convex side 113 of the suction cup 107. When the concave side 112 of the suction cup 107 is adaptively placed against the toilet 114, and the center of the suction cup 107 is pushed to the toilet 114, the air (or water depending on placement) is expelled from the space between the toilet 114 wall and the concave side 112 of the suction cup 107. As the suction cup 107 tries to recover to its original shape, a negative pressure is formed in the space between the toilet 114 wall and the concave side 112 of the suction cup 107. The positive pressure of the air (or water depending on placement) pushes against the convex side 113 of the suction cup 107 holding the securing device 102 in place. Suction cups are well known in the art.

In a first potential embodiment of the disclosure, as illustrated in FIGS. 1 through 5, the shape of the suction cup 107 is circular. This is most clearly shown in FIG. 3. In the first potential embodiment of the disclosure, the suction cup 107 is adaptively attached to an inner wall 176 of the toilet 114. This is most clearly shown in FIG. 5.

The ball portion 105 of the ball and socket joint 103 and the socket portion 108 of the ball and socket joint 103 are sized to mate with each other. When the ball portion 105 of the ball and socket joint 103 is inserted into the socket portion 108 of the ball and socket joint 103 the invention 100 is assembled. Once assembled, ball and socket joint 103 allows the position of the protective plate 104 to be adjusted to provide maximum comfort and protection. The adjustability of the protective plate 104 is accomplished by rotating the ball portion 105 with respect to the socket portion 108 of the ball and socket joint 103.

To use the invention 100, first the shield 101 is attached to the securing device 102 by inserting the ball portion 105 of the ball and socket joint 103 into the socket portion 108 of the ball and socket joint 103. The suction cup 107 is placed along the inside wall 176 of the toilet 114, and is pressed down against the inside wall 176 of the toilet 114. This secures the securing device 102 in place. The shield 101 then rotates so that the front side 110 of the protective plate 104 is in an appropriate position. When in use, the user sits on the toilet 114 and rests the male genitalia 109 on the front side 110 of the protective plate 104. The invention 100 may then be removed or left in place.

The shield 101 may be formed as a single unit of molded plastic. Appropriate plastics include, but are not limited to, polyethylene, polypropylene, or polycarbonate. The socket portion 108 of the ball and socket joint 103 may be formed as a single unit of molded plastic. Appropriate plastics include, but are not limited to, polyethylene, polypropylene, or polycarbonate. The suction cup 107 is commercially available.

Figure 6:
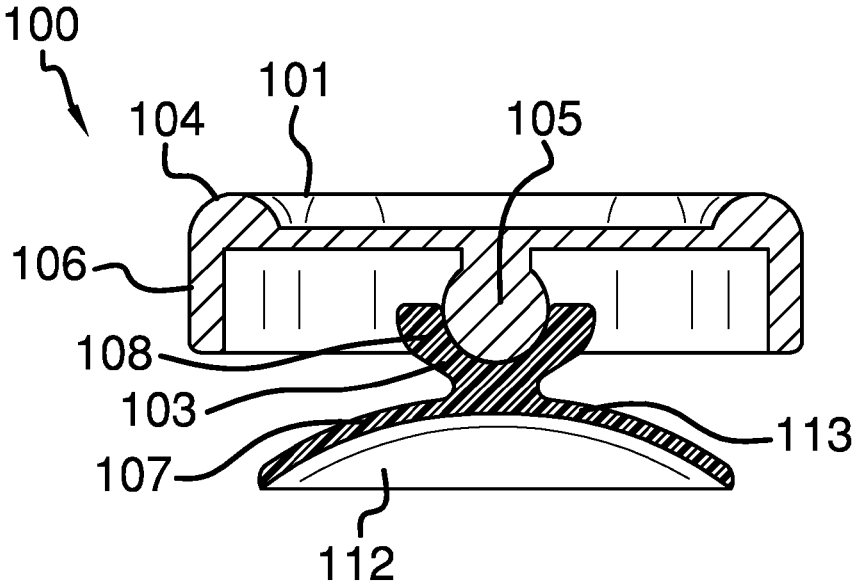
FIG. 6 is a cross-sectional view of an embodiment of the disclosure along line 6-6 in FIG. 1.

With respect to the above description, it is to be realized that the optimum dimensional relationship for the various components of the invention described above and in FIGS. 1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A toilet sanitary shield for male genitalia comprising:
a shield;
a securing device;
a ball and socket joint;
wherein the ball and socket joint are affixed between the shield and the securing device;
wherein the securing device is adapted to be secured to a toilet;
wherein the shield is adapted to receive male genitalia thereon so as to protect said male genitalia during usage of said toilet.

2. The toilet sanitary shield for male genitalia according to claim 1 wherein the shield is further defined with a protective plate, and a brim.

3. The toilet sanitary shield for male genitalia according to claim 2 wherein the shield includes a ball portion of the ball and socket joint; wherein the ball portion of the ball and socket joint attaches the protective plate to the securing device.

4. The toilet sanitary shield for male genitalia according to claim 3 wherein the brim runs along an outer edge of the protective plate; wherein the brim is adapted to contain the male genitalia that rests upon the protective plate.

5. The toilet sanitary shield for male genitalia according to claim 4 wherein the protective plate is further defined with a front side and a back side; wherein the front side is the surface that is adapted to enable the male genitalia to rest thereon.

6. The toilet sanitary shield for male genitalia according to claim 5 wherein the back side has the ball portion of the ball and socket joint attached thereto.

7. The toilet sanitary shield for male genitalia according to claim 6 wherein the brim projects out from both the front side and back side of the protective plate; wherein the brim extends upwardly from the front side of the protective plate such that the protective plate is recessed with respect to the brim.

8. The toilet sanitary shield for male genitalia according to claim 7 wherein the protective plate has a shape of an enclosed horseshoe; wherein the brim is in the form of a rounded ridge that follows along the outer edge of the front side of the protective plate.

9. The toilet sanitary shield for male genitalia according to claim 8 wherein the brim has the shape of a protective wall along the back side of the protective plate.

10. The toilet sanitary shield for male genitalia according to claim 9 wherein the ball portion of the ball and socket joint is a spherical dome or spherical segment that is attached to the back side of the protective plate; wherein the ball portion of the ball and socket joint and the socket portion of the ball and socket joint are sized to mate with each other; wherein the ball and socket joint enables the protective plate to be adjusted with respect to the toilet.

11. The toilet sanitary shield for male genitalia according to claim 10 wherein the securing device comprises a suction cup and a socket portion of the ball and socket joint; wherein the socket portion of the ball and socket joint is attached directly to the convex side of the suction cup; wherein a concave side of the suction cup is adaptively placed against the toilet, and the suction cup is pushed towards the toilet in order to secure the securing device to said toilet.

12. The toilet sanitary shield for male genitalia according to claim 11 wherein the concave side of the suction cup is adaptively attached to an inner wall of the toilet.

13. A toilet sanitary shield for male genitalia comprising:

a shield;

a securing device;

a ball and socket joint;

wherein the ball and socket joint are affixed between the shield and the securing device;

wherein the securing device is adapted to be secured to a toilet;

wherein the shield is adapted to receive male genitalia thereon so as to protect said male genitalia during usage of said toilet;

wherein the shield is further defined with a protective plate, and a brim;

wherein the shield includes a ball portion of the ball and socket joint; wherein the ball portion of the ball and socket joint attaches the protective plate to the securing device.

14. The toilet sanitary shield for male genitalia according to claim 13 wherein the brim runs along an outer edge of the protective plate; wherein the brim is adapted to contain the male genitalia that rests upon the protective plate.

15. The toilet sanitary shield for male genitalia according to claim 14 wherein the protective plate is further defined with a front side and a back side; wherein the front side is the surface that is adapted to enable the male genitalia to rest thereon; wherein the back side has the ball portion of the ball and socket joint attached thereto.

16. The toilet sanitary shield for male genitalia according to claim 15 wherein the brim projects out from both the front side and back side of the protective plate; wherein the brim extends upwardly from the front side of the protective plate such that the protective plate is recessed with respect to the brim.

17. The toilet sanitary shield for male genitalia according to claim 16 wherein the protective plate has a shape of an enclosed horseshoe; wherein the brim is in the form of a rounded ridge that follows along the outer edge of the front side of the protective plate; wherein the brim has the shape of a protective wall along the back side of the protective plate.

18. The toilet sanitary shield for male genitalia according to claim 17 wherein the ball portion of the ball and socket joint is a spherical dome or spherical segment that is attached to the back side of the protective plate; wherein the ball portion of the ball and socket joint and the socket portion of the ball and socket joint are sized to mate with each other; wherein the ball and socket joint enables the protective plate to be adjusted with respect to the toilet.

19. The toilet sanitary shield for male genitalia according to claim 18 wherein the securing device comprises a suction cup and a socket portion of the ball and socket joint; wherein the socket portion of the ball and socket joint is attached directly to the convex side of the suction cup; wherein a concave side of the suction cup is adaptively placed against the toilet, and the suction cup is pushed towards the toilet in order to secure the securing device to said toilet.

20. The toilet sanitary shield for male genitalia according to claim 19 wherein the concave side of the suction cup is adaptively attached to an inner wall of the toilet.

* * * * *